US009156291B2

(12) United States Patent
Sasaki et al.

(10) Patent No.: US 9,156,291 B2
(45) Date of Patent: Oct. 13, 2015

(54) RECORDING APPARATUS

(71) Applicant: SEIKO EPSON CORPORATION, Tokyo (JP)

(72) Inventors: Tsuneyuki Sasaki, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/596,660

(22) Filed: Jan. 14, 2015

(65) Prior Publication Data

US 2015/0202900 A1 Jul. 23, 2015

(30) Foreign Application Priority Data

Jan. 22, 2014 (JP) ..... 2014-009711

(51) Int. Cl.
*B41J 13/00* (2006.01)

(52) U.S. Cl.
CPC ..... *B41J 13/0009* (2013.01)

(58) Field of Classification Search
CPC ..... G11B 15/60
USPC ..... 360/130.21
See application file for complete search history.

(56) References Cited

U.S. PATENT DOCUMENTS

| | | | | |
|---|---|---|---|---|
| 6,719,238 | B1 * | 4/2004 | Grant et al. | 242/548.4 |
| 7,092,191 | B2 * | 8/2006 | Hashimoto et al. | 360/71 |
| 8,052,146 | B2 | 11/2011 | Sugiyama et al. | |

FOREIGN PATENT DOCUMENTS

| | | |
|---|---|---|
| JP | 08-217287 | 8/1996 |
| JP | 10-001239 | 1/1998 |
| JP | 2003-285959 | 10/2003 |
| JP | 2006-232435 | 9/2006 |
| JP | 2007-152785 | 6/2007 |
| JP | 2008-037642 | 2/2008 |
| JP | 2009-062163 | 3/2009 |

* cited by examiner

*Primary Examiner* — Mark Blouin
(74) *Attorney, Agent, or Firm* — Workman Nydegger

(57) ABSTRACT

A recording apparatus includes a transportation section that transports a recording target medium, and a control section that controls the transportation section. The transportation section includes a drive roller that is provided so as to be contacted with a first face of the recording target medium and that applies a forwarding force piece to the first face, and an air blowing section that is provided at a position opposite the drive roller and that blows air onto a second face of the recording target medium. The air blowing section performs an adjustment of an amount of air blown from the air blowing section itself under the control of the control section.

6 Claims, 7 Drawing Sheets

RECORDING APPARATUS

BACKGROUND

1. Technical Field

The present invention relates to a recording apparatus.

2. Related Art

Heretofore, there has been used a type of recording apparatus in which a recording target medium is transported by using a transportation mechanism provided with a driving roller. For example, in JP-A-2007-152785, there has been disclosed a recording apparatus in which a recording target medium is transported by using a transportation mechanism constituted by a pair of rollers which include a driving roller and which pinch the recording target medium.

In existing recording apparatuses, such a structure in which a recording target medium is transported by a transportation mechanism constituted by a pair of rollers which include a driving roller and which pinch the recording target medium is common. With respect to a pair of rollers, particularly, a type of pair of rollers, one being a driven roller disposed at an image-recorded face side of a recording target medium, the other one being a driving roller disposed at an opposite side of the recording target medium from the image-recorded face side, has been commonly used.

For such an existing recording apparatus as described above, nevertheless, a transportation defect, such as a roller mark which is left on a recording target medium as a result of such a structure in which the recording target medium is pinched by a pair of rollers, has sometimes occurred. Particularly, a case where a roller mark a driven roller leaves on an image-recorded face of a recording target medium results in degradation of recording quality has sometimes occurred.

SUMMARY

An advantage of some aspects of the invention is provision of a recording apparatus which enables prevention of the occurrence of transportation defects in transportation of a recording target medium.

A recording apparatus according to a first aspect of the invention includes a transportation section that transports a recording target medium; and a control section that controls the transportation section. Further, the transportation section includes a drive roller that is provided so as to be contacted with a first face of the recording target medium and that applies a forwarding force piece to the first face, and an air blowing section that is provided at a position opposite the drive roller and that blows air onto a second face of the recording target medium, and the air blowing section performs an adjustment of an amount of air blown from the air blowing section itself under the control of the control section.

According to this aspect, the air blowing section performs an adjustment of an amount of air blown from itself under the control of the control section. That is, through this adjustment of the amount of air blown by the air blowing section, it becomes possible to adjust the magnitude of a pinching force piece which is applied to the recording target medium through the drive roller and the air blown from the air blowing section, which pinch the recording target medium. Thus, the adjustment of the amount of blown air in accordance with, for example, a kind of a recording target medium to be used enables the transportation section to transport the recording target medium with high accuracy and, as a result, leads to prevention of the occurrence of a transportation defect.

A recording apparatus according to a second aspect of the invention, which is configured in accordance with the recording apparatus according to the first aspect of the invention, further includes a transportation amount detection section that detects an amount of transportation of the recording target medium, and the control section controls the adjustment by the air blowing section regarding the amount of air blown from the air blowing section, on the basis of the transportation amount detected by the transportation amount detection section.

According to this aspect, the control section controls the adjustment by the air blowing section regarding the amount of air blown from the air blowing section, on the basis of the transportation amount detected by the transportation amount detection section. Thus, for example, when a transportation amount detected by the transportation amount detection section is different from a predetermined reference amount, the control section can adjust the transportation amount through the adjustment by the air blowing section regarding the amount of air blown from the air blowing section. This is because the adjustment by the air blowing section regarding the amount of air blown from the air blowing section leads to an adjustment of the magnitude of a pinching force piece which is applied to the recording target medium in the transportation section, as well as an adjustment of the magnitude of a tensile force piece and the like in a transportation direction of the recording target medium.

In an recording apparatus according to a third aspect of the invention, which is configured in accordance with the recording apparatus according to the first or second aspect of the invention, the air blowing section performs an adjustment which is targeted for the amount of air blown from the air blowing section itself and which is associated with each of at least one location in a direction intersecting with a transportation direction of the recording target medium under the control of the control section.

According to this aspect, the air blowing section performs, under the control of the control section, an adjustment which is targeted for the amount of blown air and which is associated with each of at least one location in a direction intersecting with a transportation direction of the recording target medium. Thus, this adjustment which is targeted for the amount of blown air and which is associated with each of at least one location in a direction intersecting with a transportation direction of the recording target medium enables favorable transportation of the recording target medium.

A recording apparatus according to a fourth aspect of the invention, which is configured in accordance with the recording apparatus according to the third aspect of the invention, further includes a width detection section that detects a width of the recording target medium in the direction intersecting with the transportation direction of the recording target medium, and the control section controls the adjustment which is targeted for the amount of air blown from the air blowing section and which is associated with each of at least one location in the direction intersecting with the transportation direction of the recording target medium, on the basis of the width detected by the width detection section.

According to this aspect, the control section controls the adjustment which is targeted for the amount of air blown from the air blowing section and which is associated with each of at least one location in the direction intersecting with the transportation direction of the recording target medium, on the basis of the width detected by the width detection section. Accordingly, the control section can adjust the amount of air blown from the air blowing section on the basis of the width of a recording target medium to be used, and thus, for example, when a recording target medium having a narrow width is used, it becomes possible to prevent the occurrence of a waste in that the air blowing section blows air at a location not facing the recording target medium.

A recording apparatus according to a fifth aspect of the invention, which is configured in accordance with the recording apparatus according to the third or fourth aspect of the invention, further includes an oblique transportation detection section that, when the recording target medium is transported in an oblique direction, detects the oblique direction, and the control section controls the adjustment which is targeted for the amount of air blown from the air blowing section and which is associated with each of at least one location in the direction intersecting with the transportation direction of the recording target medium, on the basis of the oblique direction detected by the oblique transportation detection section.

According to this aspect, the control section controls the adjustment which is targeted for the amount of air blown from the air blowing section and which is associated with each of at least one location in the direction intersecting with the transportation direction of the recording target medium, on the basis of the oblique-transportation direction detected by the oblique transportation detection section. Thus, when the magnitude of a tensile force piece in the transportation direction of the recording target medium varies depending on a location in the direction intersecting with the transportation direction, the control section can reduce the amount of, and/or correct the direction of, the oblique transportation of the recording target medium through the adjustment which is targeted for the amount of air blown from the air blowing section and which is associated with each of at least one location in the direction intersecting with the transportation direction of the recording target medium. This is because the adjustment described above equalizes the magnitudes of the tensile force pieces in the transportation direction of the recording target medium.

In a recording apparatus according to a sixth aspect of the invention, which is configured in accordance with the recording apparatus according to any one of the first to fifth aspect of the invention, the air blowing section is a fan that blows ions.

According to this aspect, the air blowing section is a fan that blows ions. Thus, static electricity on the recording target medium is eliminated by the ions before execution of recording and, as a result, recording quality increases.

A recording apparatus according to a seventh aspect of the invention, which is configured in accordance with the recording apparatus according to any one of the first to sixth aspect of the invention, further includes a recording section, and the control section controls the adjustment of the amount of air blown from the air blowing section on the basis of a result of a determination as to whether or not recording by the recording section onto the recording target medium is in a state of being executed.

According to this aspect, the control section controls the adjustment of the amount of air blown from the air blowing section on the basis of a result of a determination as to whether or not recording by the recording section onto the recording target medium is in a state of being executed. Thus, for example, during a period when recording is not executed, the amount of air blown from the air blowing section can be reduced to a degree that does not allow the recording target medium to move. In this way, it becomes possible to prevent the occurrence of, for example, a situation in which the recording target medium is damaged by being continuously pinched with a strong pinching force piece in the transportation section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, recording apparatuses according to embodiments of the invention will be described in detail with reference to the drawings.

Embodiment 1 (FIGS. 1 to 5)

Figure 1:
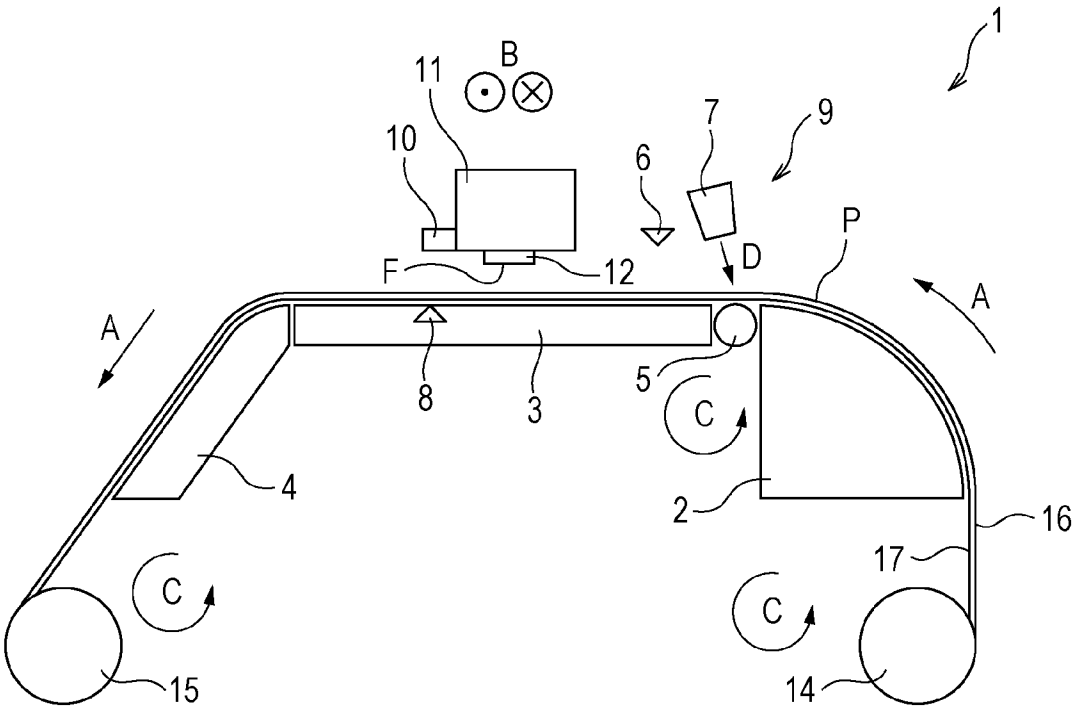
FIG. 1 is a schematic side view of a recording apparatus according to embodiment 1 of the invention.

FIG. 1 is a schematic side view of a recording apparatus 1 according to embodiment 1 of the invention.

A recording apparatus 1 according to this embodiment transports a recording target medium P in a transportation direction A from a setting portion 14 for setting the recording target medium P up to a winding portion 15 for winding the recording target medium P via a platen 2, a platen 3, and a platen 4 which constitute a supporting portion for supporting the recording target medium P. That is, a path from the setting portion 14 up to the winding portion 15 is a transportation path for the recording target medium P in the recording apparatus 1, and the platen 2, the platen 3, and the platen 4 constitute a supporting portion which is provided midway of the transportation path to as to support the recording target medium. In addition, the setting portion 14 unwinds the recording target medium P by rotating itself in a rotation direction C, and the winding portion 15 winds the recording target medium P by rotating itself in the rotation direction C.

In addition, the recording apparatus 1 according to this embodiment is configured to be capable of performing recording onto the recording target medium P which is wound in a roll state, but the configuration of the recording apparatus 1 is not limited to such a configuration and may be configured to be capable of performing recording onto the recording target medium P which is separated in a single-form state. In the case where the recording apparatus 1 according to this embodiment is configured to be capable of performing recording onto the recording target medium P which is separated in a single-form state, the setting portion 14 for the recording target medium P may be constituted by a component which is commonly called a paper feeding tray (a feeding tray), a paper feeding cassette (a feeding cassette), or the like. Further, in a collecting portion for collecting the recording target medium P, a portion other than the winding portion 15 may be constituted by a component which is commonly called a paper ejection receptor, a paper catch tray (a catch tray), a paper catch cassette (a catch cassette), or the like.

In the recording apparatus 1 according to this embodiment, a driving roller 5 is disposed between the platen 2 and the platen 3, and a fan 7, which is an air blowing portion, is disposed at a position (an upper portion) opposite the driving roller 5. The fan 7 is capable of blowing air in a direction toward the driving roller 5. Further, the fan 7 is capable of blowing air such that the air presses the recording target medium P against the driving roller 5. These driving roller 5 and fan 7 which are configured in this way constitute a transportation portion 9.

In other words, the transportation portion 9 includes the driving roller 5 which is disposed so as to be contactable with a first face 17 of the recording target medium P (the first face 17 being a face of the reverse side of the recording target medium P from an image-recorded face), and which applies a forwarding force piece to the first face 17, as well as the fan 7 which is disposed at a position opposite the driving roller 5 and which is capable of blowing air onto a second face 16 of the recording target medium P (the second face 16 being the image-recorded face).

In this way, the transportation portion 9 according to this embodiment is capable of transporting the recording target medium P such that the recording target medium P is pinched under the state in which the image-recorded face of the recording target medium P is not contacted with anything between a pairs of a driven roller and a driving roller. Thus, the occurrence of a transportation defect, such as a roller mark caused by the transportation of the recording target medium P, is prevented. In particular, the configuration is made such that the occurrence of a roller mark a driven roller leaves on the image-recorded face of the recording target medium P can be prevented.

In addition, in this embodiment, a roll-type recording target medium P, in which paper is wound such that its image-recorded face faces outward from the center of the roll, is employed, and thus, when the recording target medium P is unwound from the setting portion 14, the setting portion 14 is caused to rotate in the rotation direction C. In contrast, in the case where a roll-type recording target medium, in which paper is wound such that its image-recorded face faces inward toward the center of the roll, is employed, it is possible to configure so as to cause the setting portion 14 to unwind the recording target medium P by rotating the setting portion 14 in a rotation direction reverse to the rotation direction C.

Similarly, since the winding portion 15 according to this embodiment winds the recording target medium P such that its image-recorded face faces outward from the center of roll, the winding portion 15 is caused to rotate in the rotation direction C. In contrast, in the case where the winding portion 15 is necessary to wind the recording target medium P such that its image-recorded face faces inward toward the center of the roll, it is possible to configure so as to cause the winding portion 15 to wind the recording target medium P by rotating the winding portion 15 in a rotation direction reverse to the rotation direction C.

Further, a sensor 6 of an optical type, functioning as a detector for detecting the recording target medium P, is disposed at the downstream side of the transportation portion 9 on the transportation path along which the recording target medium P is transported in the transportation direction A. The sensor 6 detects that the recording target medium P has been guided into a portion located between the driving roller 5 and the fan 7 which face each other.

Further, in the recording apparatus 1 according to this embodiment, a recording head 12 as a recording portion is disposed at the opposite side from the platen 3. The recording apparatus 1 forms an intended image by discharging ink onto the recording target medium P from an ink discharge face F of the recording head 12 while reciprocating the carriage 11 provided with the recording head 12 in a direction intersecting with the transportation direction A.

In addition, the recording apparatus 1 according to this embodiment includes the recording head 12 which performs recording while reciprocating, but may be a recording apparatus including a so-called line head which is provided with a plurality of nozzles for discharging ink in a direction intersecting with the transportation direction A.

Here, the "line head" is a recording head which is provided such that an area of nozzles formed in an intersection direction intersecting with the transportation direction A of the recording target medium P is configured to be capable of covering the entire intersection direction of the recording target medium P, and which is used in a recording apparatus which forms an image while fixing any one of the line head and the recording target medium and moving the other one thereof. In addition, the area of the line head's nozzles formed in the intersection direction is not necessarily configured to be capable of covering the entire intersection direction of each of all kinds of recording target media P treated by the recording apparatus.

Further, in the carriage 11, there is provided a sensor 10 which plays two rolls, one being a roll as a width detector capable of detecting the width of the recording target medium P in the direction B intersecting with the transportation direction A, the other one being a roll as an oblique transportation detector capable of, when the recording target medium P is caused to be transported in an oblique direction, detecting this oblique direction. The sensor 10 will be described below in more detail.

Further, on the platen 3, there is provided a sensor 8 as a transportation amount detector capable of detecting the amount of transportation of a recording target medium. In addition, in the recording apparatus 1 according to this embodiment, the sensor 8 is disposed on the platen 3, but it may be disposed at a different place.

In addition, in the recording apparatus 1 according to this embodiment, the transportation portion 9 is disposed at an upper stream side than the recording head 12 in the transportation direction A. The transportation portion 9, however, may be disposed at each of both sides interposing the recording head 12 therebetween in the transportation direction A. In such a configuration in which the transportation portion 9 is disposed at each of the both sides, it is possible to press the recording target medium P against the driving roller 5 at each of the both sides, and thus, it becomes possible to effectively prevent the occurrence of a transportation defect, such as paper jam.

Here, the fan 7 of the transportation portion 9 is a fan that emits ions. In other word, in the recording apparatus 1 according to this embodiment, a fan capable of emitting ions is disposed at an upper stream side than the recording head 12 in the transportation direction A of the recording target medium P. Thus, it is possible to improve recording quality by eliminating static electricity on the recording target medium P through the emitted ions prior to execution of printing by the recording head 12. Further, it is possible to achieve a cost reduction by causing the transportation portion 9 to play another role as a static electricity eliminating portion for the recording target medium P. In addition, a specific example of such a fan capable of emitting ions, which is also employed in this embodiment, is an ionizer in which an ion generator and a fan are unified. In this regard, however, such a fan capable of emitting ions is not limited to the ionizer. Further, a configuration including a fan other than such a fan capable of emitting ions is also included in the scope of the invention.

Figure 2:
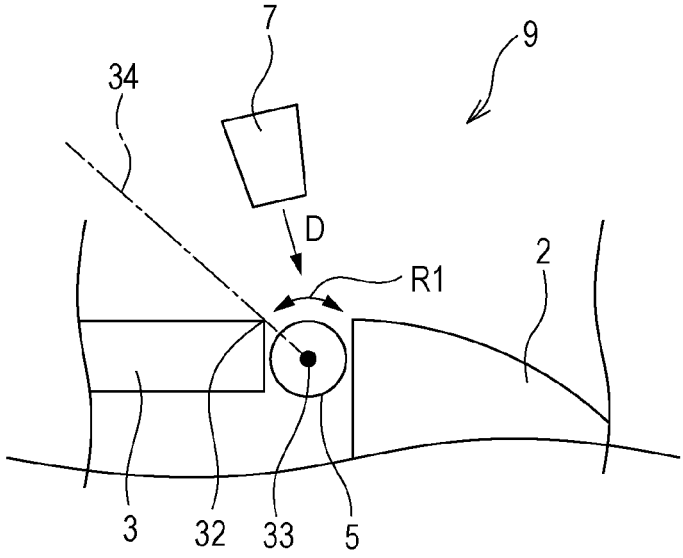
FIG. 2 is a magnified view of a main portion of a recording apparatus according to embodiment 1 of the invention.

Referring to FIG. 2, which is a magnified view of a main portion of the recording apparatus 1 of this embodiment shown in FIG. 1, the fan 7 of the transportation portion 9 blows air in the direction D which is a direction directed away from the recording head 12. Specifically, the fan 7 blows air in the direction D which is a direction targeted to the upstream side in the transportation direction A. Thus, the air blown from the fan 7 influences a flight state of ink droplets discharged from the recording head 12, and prevents the occurrence of misalignments of landing positions of the ink droplets on the recording target medium P. Further, foreign particles adhered to the second face 16 of the recording target medium P are eliminated by the air blown from the fan 7 and, as a result, the occurrence of a defect of the recording can be suppressed.

In addition, although, in this embodiment, the fan 7 blows air such that the air flows in a direction reverse to a direction toward the recording head, the fan 7 may blow air in a direction intersecting with the direction toward the recording head. In this case, the occurrence of a phenomenon, in which mists of ink discharged from the recording head 12 float between the recording head 12 and the recording target medium P, and are attached to the recording head 12 again, can be prevented and, as a result, the ink can be stably discharged from the recording head 12. In this regard, however, a configuration in which the direction of the flow of the air blown from the fan 7 corresponds to a direction toward the recording head 12 is also included in the scope of the invention. A configuration may be made such that each of fans 7*a*, 7*b*, 7*c*, and 7*d* is capable of separately changing the direction of air blown therefrom on the basis of a location of the carriage 11 in the direction B, in which the carriage 11 moves in an area at a lower stream side than the fans 7*a*, 7*b*, 7*c*, and 7*d* in the transportation direction A. For example, a configuration may be made such that, so that the air is flown in a direction reverse to the direction toward the recording head 12, at least one of the fans which is located in an area at a lower stream side than the carriage 11 in a direction in which the carriage 11 moves, relative to the direction B, blows air in a direction toward the area at the lower stream side than the carriage 11; while at least one of the fans which is located in area at an upper stream side than the carriage 11 in a direction in which the carriage 11 moves, relative to the direction B, blows air in a direction reverse to a direction toward the area at the upper stream side than the carriage 11.

Next, an electric configuration of the recording apparatus 1 according to this embodiment will be described.

Figure 3:
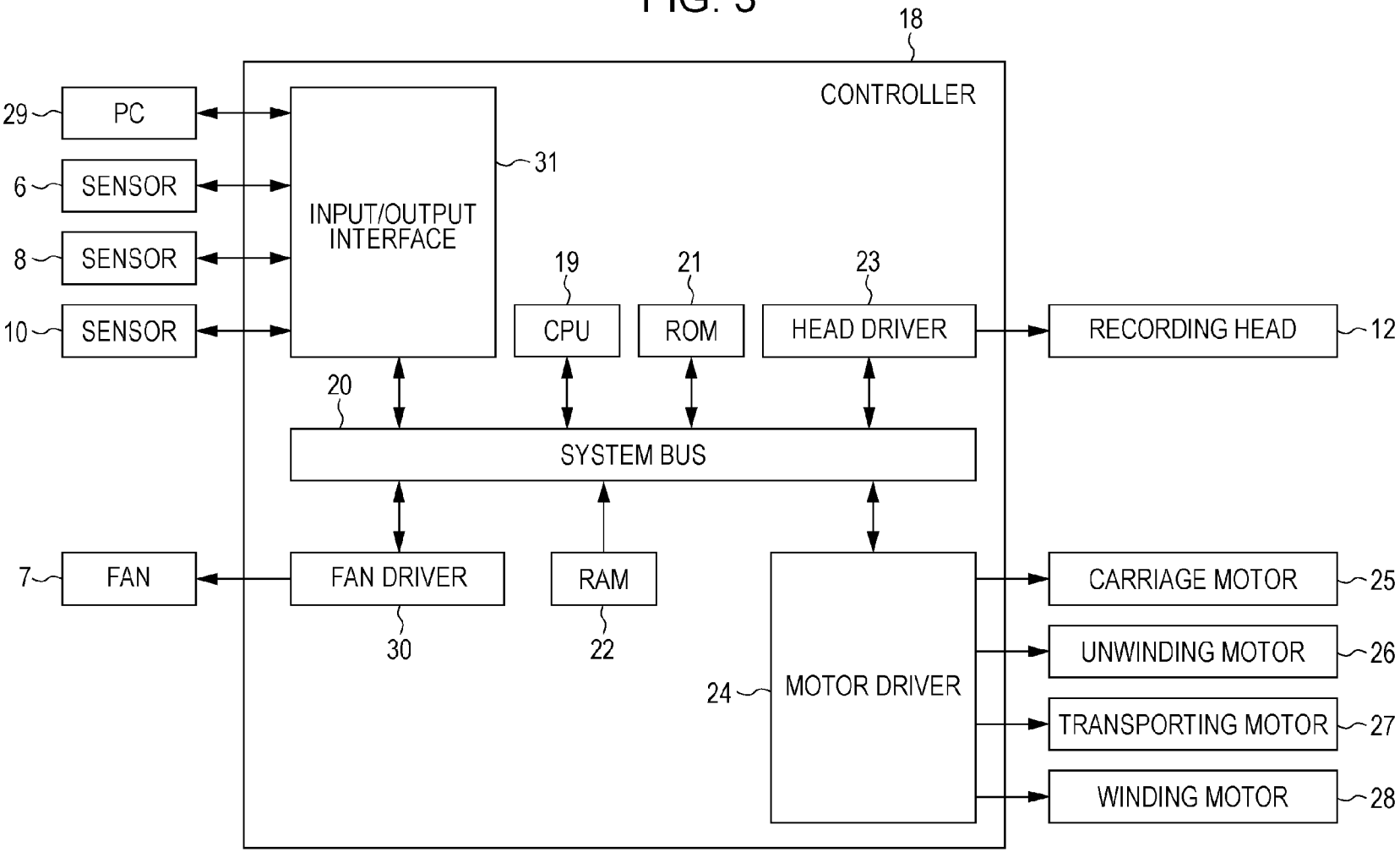
FIG. 3 is a block diagram of a recording apparatus according to embodiment 1 of the invention.

FIG. 3 is a block diagram of the recording apparatus 1 according to this embodiment.

A controller 18 includes a CPU 19 for controlling the whole of the recording apparatus 1. The CPU 19 is connected to, via a system bus 20, ROM 21 which stores therein various control programs executed by the CPU 19, maintenance sequences, and the like, and RAM 22 capable of storing data therein temporarily.

Further, the CPU 19 is connected to, via the system bus 20, a head driver 23 for driving the recording head 12.

Further, the CPU 19 is connected to, via the system bus 20, a motor driver 24 for driving a carriage motor 25 which causes the carriage 11 to reciprocate, an unwinding motor 26 which is a drive source of the setting portion 14, a transporting motor 27 which is a drive source of the driving roller 5, and a winding motor 28 which is a drive source of the winding portion 15.

Further, the CPU 19 is connected to, via the system bus 20, a fan driver 30 for driving the fan 7.

Moreover, the CPU 19 is connected to, via the system bus 20, an input/output interface 31, which is connected to sensors 6, 8, and 10, as well as a PC 29 which is an external device for inputting record data, and the like, into the recording apparatus 1.

As described above, the recording apparatus 1 according to this embodiment includes the setting portion 14 for setting the recording target medium P, the transportation portion 9 for transporting the recording target medium P, and the sensor 6 which is disposed on the transportation path and detects the recording target medium P.

Further, the controller 18 is capable of controlling the transportation portion 9, and when the sensor 6 has detected the recording target medium P, the controller 18 controls the transportation portion 9 such that the transportation portion 9 causes the fan 7 to blow air.

When the air has been blown by the fan 7, the recording target medium P having been guided into an area interposed between the driving roller 5 and the fan 7 which face each other is pressed against the driving roller 5 by the air blown from the fan 7, and this state is kept as it is. That is, the recording apparatus 1 according to this embodiment is configured so as to prevent the occurrence of a situation in which, after the recording target medium P has been guided onto the transportation path, the recording target medium P deviates from the transportation path due to the weight of the recording target medium P itself, and the like. In this way, the operability at the time when the recording target medium P is guided onto the transportation path is improved.

Further, as shown in FIG. 1, the sensor 6 of the recording apparatus 1 according to this embodiment is disposed at the downstream side of the transportation portion 9 in the direction A.

Thus, the sensor 6 highly accurately detects an event in which the recording target medium P has been guided into the area interposed between the driving roller 5 and the fan 7 which face each other. Accordingly, the recording apparatus 1 according to this embodiment is configured so as to prevent the occurrence of a waste entailed by an operation in which the fan 7 is caused to blow air before the recording target medium P is guided into the area interposed between the driving roller 5 and the fan 7 which face each other.

Further, the fan 7 of the recording apparatus 1 according to this embodiment is capable of adjusting the amount of blown air under the control of the controller 18. Specifically, as described below, the fan 7 is capable of adjusting the amount of air blown from the fan 7 itself on the basis of a location of itself in the direction B, as well as the total amount of air blown from the fan itself. Accordingly, it is possible to control the magnitude of a pinching force piece, that is, a force piece applied to the recording target medium P through the air blown from the fan 7 and the driving roller 5 which pinch the recording target medium P in the transportation portion 9.

Thus, for example, through an adjustment of the amount of blown air in accordance with a type of the recording target medium P to be used, the transportation portion 9 becomes capable of transporting the recording target medium P with high accuracy. That is, the recording apparatus 1 according to this embodiment is configured to be capable of preventing the occurrence of a defect of the transportation.

Further, as shown in FIG. 2, it is preferable to adjust the amount of transportation in advance such that the recording target medium P is pinched within a range R1 that does not pass beyond a straight line 34 which is formed by connecting a rotation shaft 33 of the driving roller 5 and the upper corner of an outer edge 32 which is the downstream side edge of the platen 3 in the direction A. Through such a configuration, it becomes possible to stably transport the recording target medium P.

Further, the recording apparatus 1 according to this embodiment includes a sensor 8 capable of detecting the mount of transportation of the recording target medium P.

Further, the controller 18 is capable of controlling the adjustment of the amount of air blown from the fan 7 on the basis of the transportation amount detected by the sensor 8.

Thus, for example, when a value of the transportation amount detected by the sensor 8 is different from a predetermined reference value, the controller 18 adjusts the transportation amount by appropriately controlling the adjustment of the amount of air blown from the fan 7. Here, through the adjustment of the amount of air blown from the fan 7, the magnitude of the pinching force piece in the transportation portion 9, the magnitude of a tensile force piece of the recording target medium P in the direction A, and the like, are adjusted and, as a result, the transportation amount is adjusted.

Further, as described above, the recording apparatus 1 according to this embodiment includes the recording head 12 as a recording portion that performs recording onto the recording target medium P.

Further, the controller 18 is capable of adjusting the amount of air blown from the fan 7 on the basis of a result of a determination as to whether or not the recording by the recording head 12 onto the recording target medium P is in the state of being performed.

Thus, for example, during a period when recording is not executed, the amount of air blown from the fan 7 can be reduced to a degree that does not allow the recording target medium P to move. Further, during a period when the carriage 11 does not exist on an area on the platen 3, blowing of air by the fan 7 may be brought to a halt. In this way, the recording apparatus 1 according to this embodiment is configured to be capable of preventing the occurrence of a situation in which the recording target medium P is damaged by being continuously pinched with a strong pinching force piece in the transportation portion 9.

Next, the sensors 7 and 8 as well as a sensor 10 will be described in detail with respect to respective configurations and functions.

Figure 4:
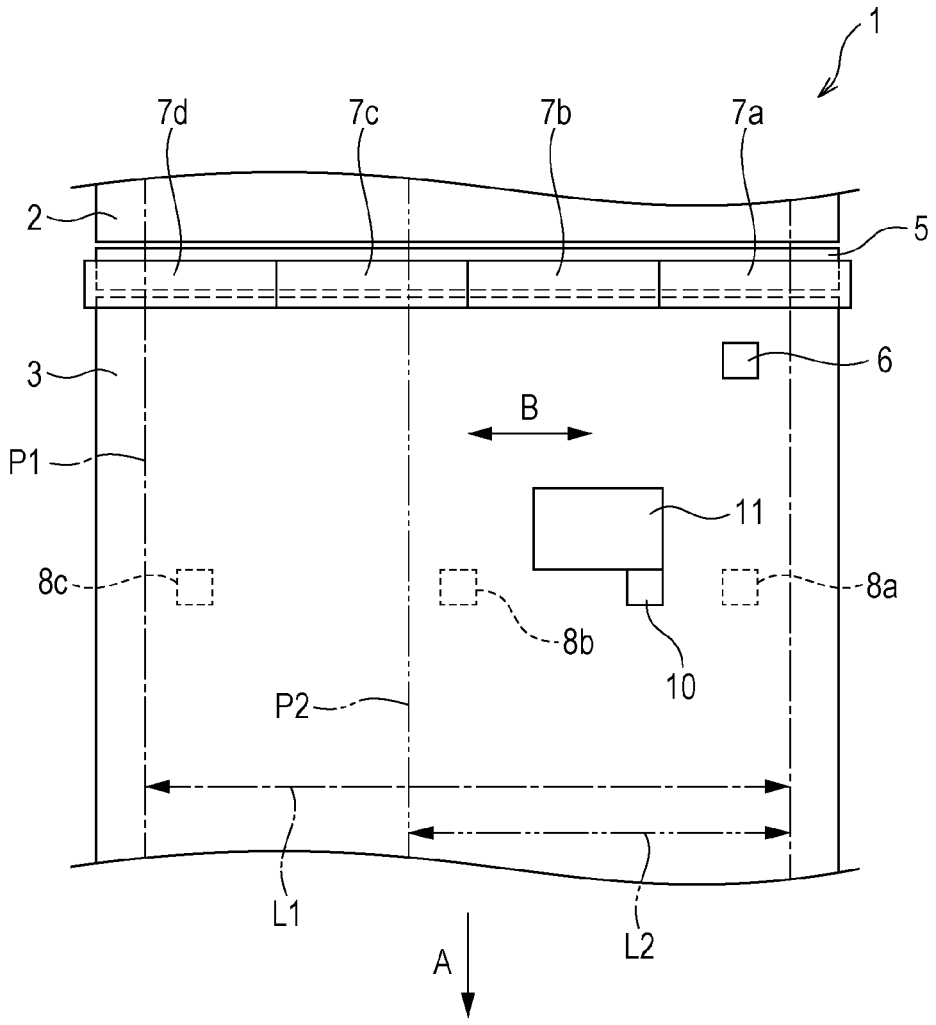
FIG. 4 is a schematic plan view of a recording apparatus according to embodiment 1 of the invention.
Figure 5:
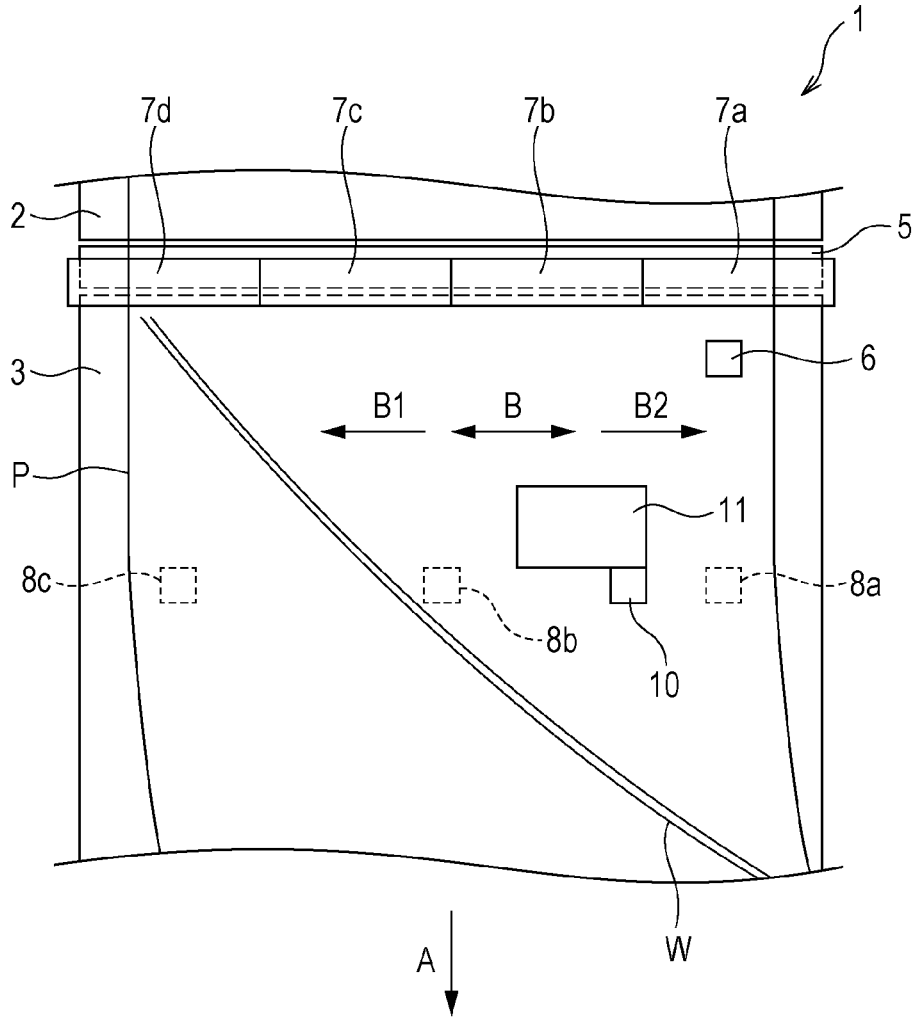
FIG. 5 is a schematic plan view of a recording apparatus according to embodiment 1 of the invention.

FIGS. 4 and 5 are schematic plan views each illustration the recording apparatus 1 according to this embodiment. Specifically, in FIG. 4, an area available for supporting the recording apparatus 1 on the platen 3 of the recording apparatus 1 is illustrated. Further, in FIG. 5, a case where the recording target medium P is obliquely transported is schematically illustrated.

The fan 7 of the recording apparatus 1 according to this embodiment is constituted by four fans 7*a*, 7*b*, 7*c*, and 7*d* which are separately arranged in the direction B, and the fan 7 is configured to be capable of adjusting the amount of blown air on the basis of a location in the direction B under the control which is separately performed on the fans 7*a*, 7*b*, 7*c*, and 7*d* by the controller 18.

That is, the fan 7 is capable of adjusting the amount of blown air on the basis of a location in the direction B intersecting with the transportation direction A under the control of the controller 18. Thus, the recording apparatus 1 according to this embodiment is configured to be capable of appropriately transporting the recording target medium P by performing an adjustment which is targeted for the amount of blown air and which is associated with each of some locations in the direction B.

In addition, although the fan 7 according to this embodiment is constituted by four fans which are separately arranged in the direction B, the fan 7 may be constituted by three or less separately arranged fans or five or more separately arranged fans. Further, it is possible to increase the speed of blown air to a desired speed by narrowing an air-blowing outlet of the fan 7. The fan 7 may incorporate a heater to blow warm air. In this case, the recording target medium P is warmed by the heater and, as a result, when an intended image is formed by discharging ink onto the recording target medium P from the ink discharge face F of the recording head 12, drying of the ink is further accelerated.

Further, in the recording apparatus 1 according to this embodiment, sensors 8*a*, 8*b*, and 8*c* are disposed in order from a home position side in the direction B, wherein this home position is associated with the right-hand side of each of FIGS. 4 and 5.

The sensor 6 is disposed at a position which is located at the home position side in the direction B and which faces the platen 3.

In addition, the positions and the number of the sensors 8 are not limited to those in this embodiment, and the position of the sensor 6 is not limited to that in this embodiment.

In the recording apparatus 1 according to this embodiment, as shown in FIG. 4, a recording target medium P1 having a width L1 and a recording target medium P2 having a width L2 can be used as the recording target medium P. In addition, the width of the recording target medium P can be detected by allowing the carriage 11 to reciprocate in the direction B and allowing the sensor 10 mounted on the carriage 11 to detect the recording target medium P. That is, the recording apparatus 1 according to this embodiment includes the sensor 10 as a width detector capable of detecting the width of the recording target medium P in the direction B.

Further, the controller 18 is capable of controlling an adjustment which is targeted for the amount of air blown from the fan 7 and which is associated with each of some locations in the direction B, on the basis of the width of the recording target medium P, detected by the sensor 10.

Thus, the amount of air blown from the fan 7 can be adjusted on the basis of the width of a currently used recording target medium P. For example, when the recording target medium P2 having a narrow width is used, it is possible to prevent the occurrence of a waste in which the air is blown at a position not facing the recording target medium P by performing control so as to cause the fan 7*d* located at a position not facing the recording target medium P not to blow the air.

In addition, the recording apparatus 1 according to this embodiment is configured to be capable of handling two types of recording target media P, that is, the recording target medium P1 having the width L1 and the recording target medium P2 having the width L2, but, without being limited to this configuration, the recording apparatus 1 may be configured to be capable of handling three or more types of recording target media P having mutually different widths.

Further, as described above, the sensor 10 is configured to be capable of, when the recording target medium P is transported in an oblique direction, detecting the oblique direction. Specifically, the sensor 10 according to this embodiment is configured to be capable of measuring a distance (PG) between the recording target medium P and the sensor 10 at each of a plurality of detection positions in the transportation direction A. Here, for example, as shown in FIG. 5, in the case where, as the recording target medium P is transported further toward the downstream side in the transportation direction A, the recording target medium P is obliquely transported such that its location in the direction B becomes near the home position side (the right-hand side in FIG. 5), there arises a ruck W which is formed such that, as any point on the ruck W moves further along the ruck W toward the downstream side in the transportation direction A, the location of the point becomes nearer the right-hand side in FIG. 5. When such a ruck W arises, the sensor 10 is more likely to detect an abnormal condition of the PG at a lower stream side position than at an upper stream side position in the transportation direction A. Through such a configuration, the sensor 10 is configured to, when the recording target medium P is transported in an oblique direction, be capable of detecting the oblique direction. In this regard, however, the configuration of the sensor 10 is not limited to this configuration.

As described above, the recording apparatus 1 according to this embodiment includes the sensor 10 capable of, when the recording target medium P is transported in as oblique direction, be capable of detecting the oblique direction.

Further, the controller 18 is capable of controlling the adjustment which is targeted for the amount of air blown from the fan 7 and which is associated with each of some locations in the direction intersecting with the transportation direction of the recording target medium P, on the basis of the oblique direction detected by the sensor 10.

Thus, the recording apparatus 1 is configured to be capable of, in the case where the oblique movement of the recording target medium P causes the magnitude of a tensile force piece of the recording target medium P in the transportation direction A to be different depending on a location in the direction B, reducing the amount of, and/or correcting the direction of, the oblique movement of the recording target medium P by equalizing the magnitudes of the tensile force pieces in the direction B through the adjustment which is targeted for the amount of air blown from the fan 7 and which is associated with each of some locations in the direction B. For example, in the case where the recording target medium P is intermittently transported, during a period when an intended image is formed by discharging ink onto the recording target medium P from the ink discharge face F of the recording head 12 in conjunction with the reciprocation of the recording head 12 attached to the carriage 11 in the direction B intersecting with the transportation direction A, the amount of air blown by each of the fans 7*a*, 7*b*, 7*c*, and 7*d* at a corresponding one of locations in the direction B is made constant; while, during another period when the transportation target medium P on which the intended image has been formed is transported, each of the amount of air blown by the fan 7*a* and that by the fan 7*b* is made smaller than each of the amount of air blown by the fan 7*c* and that by the fan 7*d*, or each of the amount of air blown by the fan 7*c* and that by the fan 7*d* is made larger than each of the amount of air blown by the fan 7*a* and that by the fan 7*b*. In this way, it becomes possible to prevent the occurrence of a defect in that, during a period when an image is formed, the variation of the amount of air blown by each of the fans 7*a*, 7*b*, 7*c*, and 7*d* causes the recording target medium P to float from the surface of the platen 3 and be brought into contact with the carriage 11.

Moreover, the recording apparatus 1 according to this embodiment includes the plurality of sensors 8*a*, 8*b*, and 8*c* in the direction B as the sensor 8 which functions as a transportation amount detector capable of detecting the amount of transportation of the recording target medium P, and thus, the recording apparatus 1 is also capable of detecting the oblique direction from differences among the transportation amounts regarding the recording target medium P, each being detected by a corresponding one of the sensors 8*a*, 8*b*, and 8*c*. Further, the controller 18 is also capable of controlling the adjustment which is targeted for the amount of air blown from the fan 7 and which is associated with each of some locations in the direction intersecting with the transportation direction of the recording target medium P, on the basis of the oblique direction detected by the sensor 8.

Figure 6:
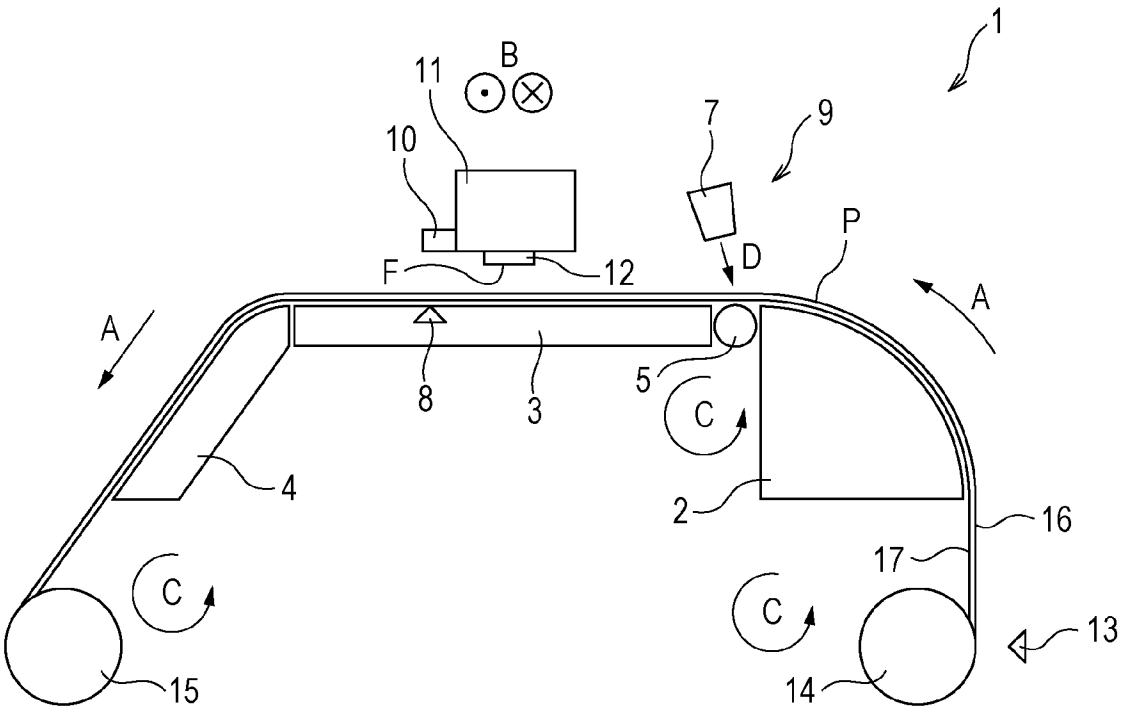
FIG. 6 is a schematic side view of a recording apparatus according to embodiment 2 of the invention.

Embodiment 2 (FIG. 6)

Next, a recording apparatus according to embodiment 2 will be described in detail with reference to some of the accompanying drawings.

FIG. 6 is a schematic side view of a recording apparatus 1 according to this embodiment. In addition, any constituent member common to one of the aforementioned constituent members of the foregoing embodiment is denoted by the same reference sign as that of the one of the aforementioned constituent members, and detailed description thereof is omitted here.

The recording apparatus 1 according to this embodiment has the same configuration as that of the recording apparatus 1 according to embodiment 1 except that, in substitution for the optical type sensor 6, which functions as a detector for detecting the recording target medium P and which is disposed at the downstream side of the transportation portion 9, an optical type sensor 13 functioning as a detector for detecting the recording target medium P is disposed in the setting portion 14.

The recording apparatus 1 according to this embodiment includes a setting portion 14 and a transportation portion 9 each configured in the same way as that of the recording apparatus 1 according to embodiment 1.

Further, as described above, a sensor 13 for detecting the recording target medium P is disposed in the setting portion 14.

When the sensor 13 has detected the recording target medium P, a controller 18 controls the transportation portion 9 such that the transportation portion 9 causes a fan 7 to blow air.

In this way, the controller 18 controls the transportation portion 9 such that the transportation portion 9 causes the fan 7 to blow air when the sensor 13 has detected the recording target medium P, that is, when the recording target medium has been set in the setting portion 14. Thus, the recording apparatus 1 according to this embodiment is configured to, just like the recording apparatus 1 according to embodiment 1, so as to prevent the occurrence of a situation in which, after the recording target medium P has been guided onto the transportation path, the recording target medium P deviates from the transportation path due to the weight of the recording target medium P itself, and the like. In this way, the operability at the time when the recording target medium P is guided onto the transportation path is improved.

In addition, in the case where a period of time from a time point when the recording target medium P is set into the setting portion 14 until a time point when the recording target medium P is guided onto a transportation path for the recording target medium P is longer than a predetermined period of time, the controller 18 may be configured to perform control such that blowing of air from the fan 7 is brought to halt.

Figure 7:
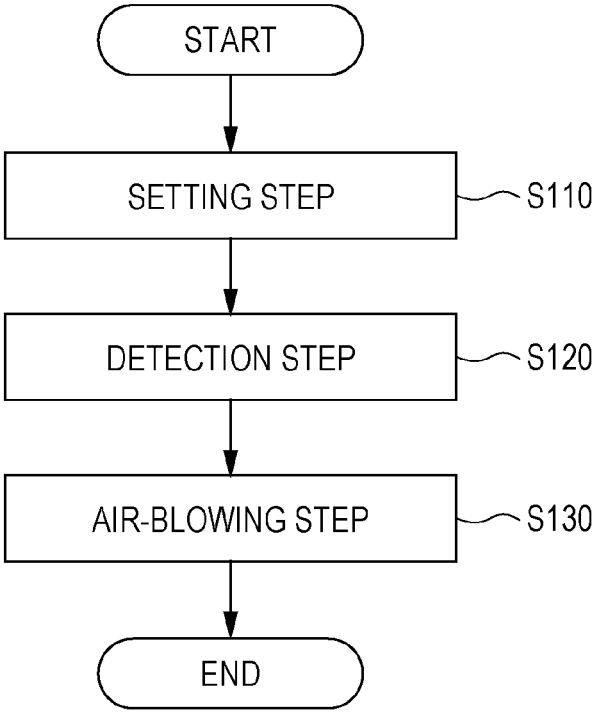
FIG. 7 is a flowchart illustrating processing for guiding a recording target medium onto a transportation path, according to an embodiment of the invention.

Embodiment of Method for Guiding Recording Target Medium onto Transportation Path (FIG. 7)

Next, an embodiment of a method for guiding a recording target apparatus onto a transportation path, using the recording apparatus 1 according to embodiment 1, will be described.

FIG. 7 is a flowchart illustrating a method for guiding a recording target medium onto a transportation path, according to this embodiment.

In the method for guiding a recording target medium into a transportation path, according to this embodiment, first, in a setting step in step S110, a user sets the recording target medium P into the setting portion 14 of the recording apparatus 1.

After the setting of the recording target medium P by the user, in a detection step in step S120, the recording target medium P is detected. In addition, since, in this embodiment, the recording apparatus 1 according to embodiment 1 is used, this step corresponds to the step in which a user guides the recording target medium P onto a transportation path and the sensor 6 detects the recording target medium P having been guided onto the transportation path. Nevertheless, for example, this step may correspond to a step using the recording apparatus 1 according to embodiment 2, in which the sensor 13 detects that the recording target medium P has been set into the setting portion 14.

After the detection of the recording target medium P in step S120, in an air-blowing step in step S130, the fan 7, which is capable of blowing air onto the second face 16 of the recording target medium P having been placed at a position opposite the driving roller 5, blows air toward the driving roller 5 which is disposed so as to be contactable with the first face 17 of the recording target medium P and which applies a forwarding force piece to the first face 17.

In the method for guiding a recording target medium onto a transportation path, according to this embodiment, it is possible to prevent the occurrence of a situation in which, after the recording target medium P has been guided onto the transportation path, the recording target medium P deviates from the transportation path due to the weight of the recording target medium P itself, and the like. In this way, the operability at the time when the recording target medium P is guided onto the transportation path is improved.

The entire disclosure of Japanese Patent Application No. 2014-009711, filed Jan. 22, 2014 is expressly incorporated by reference herein.

What is claimed is:

1. A recording apparatus comprising:

a transportation section that transports a recording target medium;

a control section that controls the transportation section; and a transportation amount detection section that detects an amount of transportation of the recording target medium, wherein the transportation section includes a drive roller that is provided so as to be contacted with a first face of the recording target medium and that applies a forwarding force piece to the first face, and an air blowing section that is provided at a position opposite the drive roller and that blows air onto a second face of the recording target medium, wherein the air blowing section performs an adjustment of an amount of air blown from the air blowing section itself under the control of the control section, and wherein the control section controls the adjustment by the air blowing section regarding the amount of air blown from the air blowing section, on the basis of the transportation amount detected by the transportation amount detection section.

2. The recording apparatus according to claim 1, wherein the air blowing section is a fan that blows ions.

3. A recording apparatus comprising:

a transportation section that transports a recording target medium; and a control section that controls the transportation section, wherein the transportation section includes a drive roller that is provided so as to be contacted with a first face of the recording target medium and that applies a forwarding force piece to the first face, and an air blowing section that is provided at a position opposite the drive roller and that blows air onto a second face of the recording target medium, wherein the air blowing section performs an adjustment of an amount of air blown from the air blowing section itself under the control of the control section, and wherein the air blowing section performs an adjustment which is targeted for the amount of air blown from the air blowing section itself and which is associated with each of at least one location in a direction intersecting with a transportation direction of the recording target medium under the control of the control section.

4. The recording apparatus according to claim 3, further comprising:

a width detection section that detects a width of the recording target medium in the direction intersecting with the transportation direction of the recording target medium, wherein the control section controls the adjustment which is targeted for the amount of air blown from the air blowing section and which is associated with each of at least one location in the direction intersecting with the transportation direction of the recording target medium, on the basis of the width detected by the width detection section.

5. The recording apparatus according to claim 3, further comprising:

an oblique transportation detection section that, when the recording target medium is transported in an oblique direction, detects the oblique direction, wherein the control section controls the adjustment which is targeted for the amount of air blown from the air blowing section and which is associated with each of at least one location in the direction intersecting with the transportation direction of the recording target medium, on the basis of the oblique direction detected by the oblique transportation detection section.

6. A recording apparatus comprising:

a transportation section that transports a recording target medium;

a control section that controls the transportation section; and a recording section, wherein the transportation section includes a drive roller that is provided so as to be contacted with a first face of the recording target medium and that applies a forwarding force piece to the first face, and an air blowing section that is provided at a position opposite the drive roller and that blows air onto a second face of the recording target medium, wherein the air blowing section performs an adjustment of an amount of air blown from the air blowing section itself under the control of the control section, and wherein the control section controls the adjustment of the amount of air blown from the air blowing section on the basis of a result of a determination as to whether or not recording by the recording section onto the recording target medium is in a state of being executed.

* * * * *